US006755889B2

(12) United States Patent
Bilodeau et al.

(10) Patent No.: US 6,755,889 B2
(45) Date of Patent: Jun. 29, 2004

(54) PROCESS FOR CLEANING AND PURIFYING MOLTEN ALUMINUM

(75) Inventors: Jean-Francois Bilodeau, Jonquiere (CA); Ghyslain Dube, Chicoutimi (CA); Claude Dupuis, Jonquiere (CA); Sebastien Fafard, Jonquiere (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/458,602

(22) Filed: Jun. 10, 2003

(65) Prior Publication Data

US 2003/0196518 A1 Oct. 23, 2003

Related U.S. Application Data

(62) Division of application No. 09/766,924, filed on Jan. 22, 2001, now Pat. No. 6,602,318.

(51) Int. Cl.[7] ..... C22B 9/05
(52) U.S. Cl. ..... 75/414; 75/683
(58) Field of Search ..... 75/414, 683

(56) References Cited

U.S. PATENT DOCUMENTS

| | | | | |
|---|---|---|---|---|
| 3,849,119 A | | 11/1974 | Bruno et al. | 75/68 R |
| 4,022,614 A | * | 5/1977 | Valdo | 75/685 |
| 4,109,898 A | | 8/1978 | Lautjärvi et al. | 266/217 |
| 4,832,740 A | | 5/1989 | Meier | 75/68 R |
| 4,913,735 A | | 4/1990 | Palmer | 75/683 |
| 5,080,715 A | | 1/1992 | Provencher et al. | |
| 5,405,427 A | * | 4/1995 | Eckert | 75/685 |
| 5,413,315 A | | 5/1995 | Venas et al. | |
| 6,060,013 A | | 5/2000 | Le Brun et al. | 266/217 |
| 6,106,588 A | | 8/2000 | Skibo et al. | |
| 6,589,313 B2 | * | 7/2003 | Bilodeau et al. | 75/414 |
| 6,602,318 B2 | * | 8/2003 | Bilodeau et al. | 75/414 |

FOREIGN PATENT DOCUMENTS

| | | | |
|---|---|---|---|
| CA | 2272976 | | 11/1999 |
| CH | 651320 | | 9/1985 |
| EP | 0260930 | | 3/1988 |
| EP | 0620285 | | 10/1994 |
| GB | 1422055 | | 1/1976 |
| JP | 05-117772 | * | 5/1993 |

OTHER PUBLICATIONS

AN–1993–124764 [15] Abstract of SU1730190, Apr. 30, 1992 (Database WPI, Derwent Publication, XP–002211318).

Patent Abstracts of Japan, vol. 013, No. 286 (c–613), Jun. 29, 1989, Abstract of JP 01–079329, Mar. 24, 1989.

* cited by examiner

*Primary Examiner*—Melvyn Andrews
(74) *Attorney, Agent, or Firm*—Cooper & Dunham LLP

(57) ABSTRACT

A process is described for treating molten metal with a particulate treating agent. A melt of a metal, e.g. aluminum, is provided in a treatment vessel such as a ladle and a mixing impeller is positioned substantially below the surface of the molten metal. The impeller comprises a plate with a series of spaced blades extending from the surface of the plate. This impeller is adapted to provide high shear mixing with minimum vortex. While rotating the impeller on a substantially vertical axis, particulate treating agent is fed by way of an injection tube below the surface of the molten metal and into the region between the axis and periphery of the impeller. This causes a high shearing action in the region of the blades whereby the treating agent is quickly broken down into finely divided droplets that are at least partially molten and which are circulated within the molten metal.

11 Claims, 4 Drawing Sheets

PROCESS FOR CLEANING AND PURIFYING MOLTEN ALUMINUM

CROSS REFERENCE TO RELATED APPLICATION

This application is a division of U.S. patent application Ser. No. 09/766,924, filed Jan. 22, 2001 now U.S. Pat. No. 6,602,318.

BACKGROUND OF THE INVENTION

This invention relates to a process and apparatus for treating molten metals, e.g. molten aluminum, with particulate treating agents particularly for inclusion removal, and removal of non-metallic or metallic elements.

It has long been a practice within the aluminum industry to treat molten aluminum with particulate treating agents such as halide salts for inclusion removal and alkali metal removal. For instance, $MgCl_2$ may be added for alkali removal and a mixture of NaCl, KCl and cryolite may be used for solids removal from the molten aluminum.

One such previous system is described in Venas et al. U.S. Pat. No. 5,413,315, where a particulate treating agent is injected together with a gas downwardly through a hollow drive shaft having a cone-shaped rotor on the bottom end thereof. The mixture of particulate treating agent and gas is fed into the cone-like zone and a mechanism is also provided for withdrawing excess gas from the cone-like zone. A main principal of this design appears to be achieving mixing of the particulate treating agent with the molten aluminum with little agitation.

Other methods of treating molten aluminum with particulate treating agents are described in Forberg et al. Canadian Application 2,272,976, laid-open Nov. 27, 1999. This document describes a number of rotors used for crucible processing. Some of these rotors are of the shearing type with projecting teeth. Treatment salt is added either through the rotor or separately adjacent the rotor.

Skibo et al. U.S. Pat. No. 6,106,588 describes another device with a toothed rotor for injecting particulate material into molten aluminum. However, this is designed for adding particulates of material such as silicon carbide or alumina which do not dissolve or melt within the molten aluminum. Accordingly, the invention is concerned with the creation of high shear regions to facilitate wetting of the particulate material which is by its nature difficult to wet.

British Patent 1,422,055 discloses an apparatus for injecting a powder into a molten metal in a crucible that comprises a lance with an angled tip. A salt is delivered to the end of the lance by a screw device and gas is used in sufficient quantity to keep the metal out of the lance tip.

Yet another system for treating molten aluminum is described in Provencher et al. U.S. Pat. No. 5,080,715 where a salt is injected in a vortex while a gas is injected by a shaft.

It is an object of the present invention to provide an improved process for adding particulate treating agents to a molten metal, such as molten aluminum.

It is a further object to provide such improved process in which a minimum amount of gas is introduced into the molten metal and a maximum contact between the treating agent and the molten metal is achieved.

SUMMARY OF THE INVENTION

This invention in its broadest aspect relates to a process for treating molten metal with a particulate treating agent. In this process, a melt of a metal is provided in a treatment vessel such as a ladle. A mixing impeller is positioned substantially below the surface of the molten metal. The impeller comprises a plate with a series of spaced blades extending from the surface of the plate. This impeller is adapted to provide high shear mixing with minimum vortex. While rotating the impeller on a substantially vertical axis, particulate treating agent is fed by way of an injection tube below the surface of the molten metal and into the region between the axis and periphery of the impeller. This causes a high shearing action in the region of the blades whereby the treating agent is quickly broken down into finely divided, at least partially molten droplets which are circulated within the molten metal.

Preferably the blades are located at the periphery of the plate which is circular and are oriented tangential to the edge of the plate, i.e. the long dimension of the blades lies on a tangent to the movement of the impeller plate.

The treating agent is fed as a dense phase feed accompanied by the minimum amount of gas sufficient only to maintain a clear flow of the treating agent and to prevent any molten metal from travelling into the end of the conduit delivering the particulate material. The gas is preferably an inert gas, such as argon, helium or nitrogen, and is fed into a closed reservoir for the treating agent.

It has been found that by careful placement of the inlet for the particulate treating agent relative to the impeller, the treating agent is very quickly broken down by the blades into finely divided droplets which disperse throughout the molten metal. By quickly breaking down the treating agent droplets in the vicinity of the impeller blades, the efficiency is greatly improved because the surface contact between the treating agent and the molten metal is greatly increased. Furthermore, because the amount of gas added is much lower than normally used, there is a decreased tendency for the treating agent to be carried by gas bubbles to the top of the molten metal without having served its treatment purposes.

A further aspect of the invention comprises an apparatus for carrying out the above process. This apparatus includes:

(a) a treatment vessel adapted to hold molten metal, (b) an impeller mounted on the lower end of a drive shaft extending substantially vertically downwardly into the vessel, the impeller comprising a plate with a series of spaced blades extending from a surface of the plate and being adapted to provide high shear mixing of molten metal contained in the vessel with minimum vortex, (c) injector means for feeding a particulate treating agent into a region between the axis of the drive shaft and the periphery of the impeller, and (d) means for rotating said drive shaft and impeller whereby said high shear mixing is achieved.

In one preferred embodiment of the invention the peripheral impeller blades are directed upwardly and the treating agent is fed downwardly through an fixed injection tube to a region between the axis and the periphery of the impeller.

In a further preferred embodiment, the peripheral impeller blades are directed downwardly on the bottom face of the impeller plate and the impeller is mounted on a hollow, rotatable drive shaft with the treating agent being fed downwardly through the hollow shaft to emerge beneath the impeller in a region between the exit of the hollow drive shaft and the downwardly directed peripheral blades of the impeller.

Additional radially mounted stirring blades may be used to provide additional general mixing of the molten metal within the vessel. These radially mounted stirring blades may be mounted on the reverse face of the impeller plate from the position of the peripheral blades. When such radially mounted stirring blades are mounted on the upper surface of the impeller plate they must be of sufficiently small area that they do not create any significant vortex in the metal.

The control of the vortex can be achieved by controlling the cross-sectional area of the blades perpendicular to the movement of the blades. In particular, the ratio of the volume swept by the blades to the area of the impeller plate perpendicular to the axis of rotation should not exceed 0.06 metres. The ratio is preferably in the range 0.002 to 0.06 metres.

According to a further embodiment of the invention, radially mounted blades may be used in place of the peripherally mounted tangential blades to create the required high shearing action. These radial blades thus serve to provide both the high shearing action and general mixing. They must, of course, also be designed as above to not create any significant vortex.

The peripheral speed of travel of the blades together with the location of the injection of the particulate treating agent provides a very high intensity initial contact between the treating agent and the metal particularly in the region of the outer periphery of the blades. Thus, a very high shearing action is created which serves to generate finely divided droplets of the treating agent. The blades typically travel at a tangential or peripheral velocity (measured at the outer periphery of the blades) of about 5–20 m/sec. Preferably they travel at a tangential or peripheral velocity of at least 8 m/sec.

According to a preferred feature of this invention, the impeller is operated only for a short period of time, e.g. less than 5 minutes (more preferably less than 3 minutes), under high intensity shearing conditions to disperse fine salt droplets, followed by a longer period (up to 10 minutes more preferably up to 5 minutes) of slow or non-mixing while the dispersed salt droplets are permitted to react within the molten aluminum.

BRIEF DESCRIPTION OF THE DRAWINGS

The invention is illustrated by way of example with reference to the drawings in which.

DESCRIPTION OF THE PREFERRED EMBODIMENTS

Figure 1:
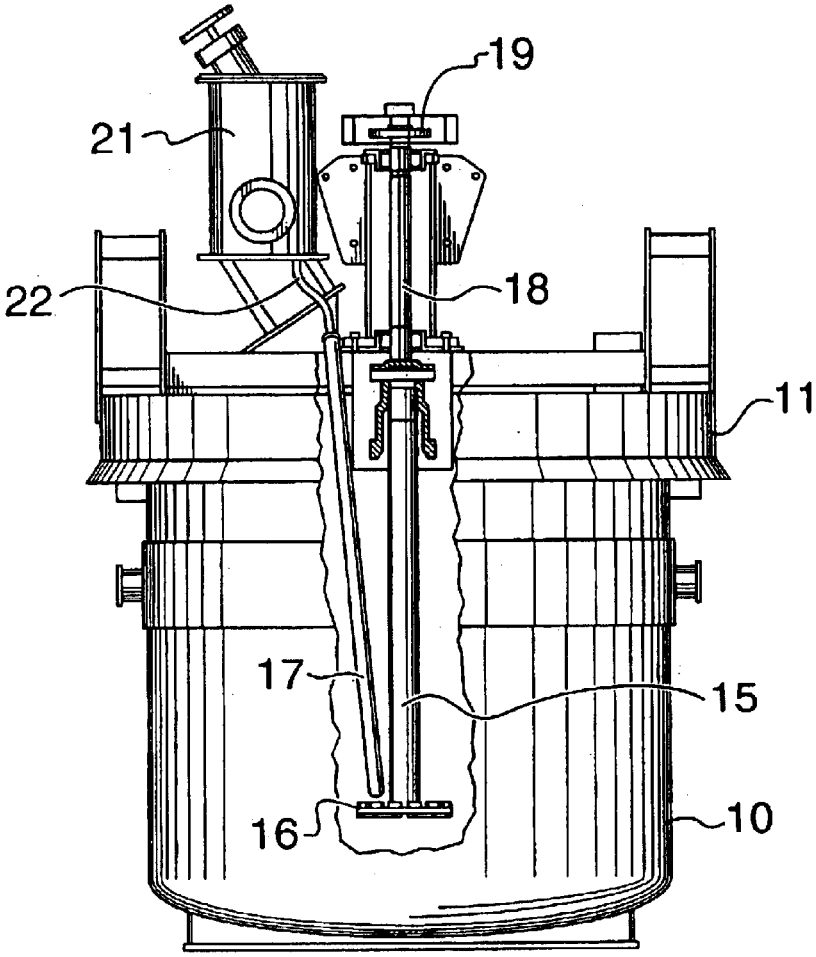
FIG. 1 is an elevation view in partial section of a treatment vessel according to the invention.

A vessel 10, e.g. a ladle, is provided for holding molten aluminum. This ladle 10 is covered by a cover assembly 11 which supports the mixing and feeding systems.

Extending downwardly from cover 11 is a graphite drive shaft 15 to the bottom of which is connected an impeller 16. The upper end of shaft 15 is connected to a further drive shaft 18 having a pulley 19 for connection to a drive motor 20 by way of a belt.

An injection tube 17 for treating agent extends downwardly to the vicinity of the top face of the impeller 16 as can be seen in FIGS. 1 to 4. The upper end of injection tube 17 connects by way of a flexible tube 22 to a reservoir 21 for the particulate treating agent. The reservoir is a closed vessel and is slightly pressurized with an inert gas. Treatment agent delivered to the upper end of the injection tube falls to the bottom under gravity. A small flow of gas is maintained through the tube to prevent metal from flowing back up the tube. The amount of gas required to do this is preferably in the range of 1 to 40 standard litres of gas per kilogram of added treatment agent.

Figure 2:
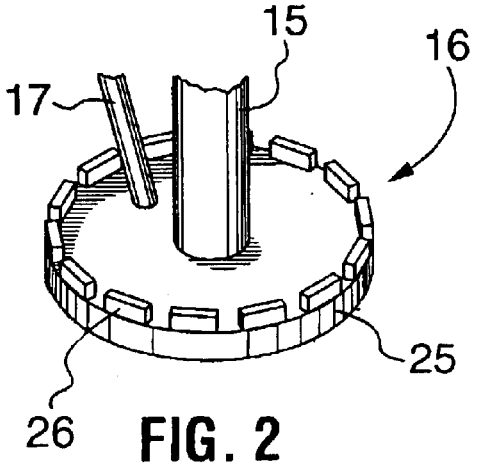
FIG. 2 is a perspective view of an impeller.
Figure 3:
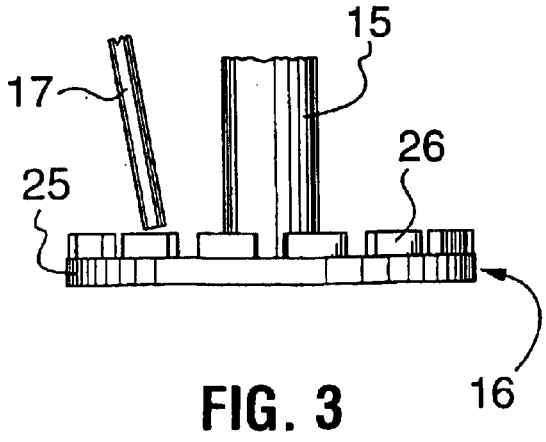
FIG. 3 is an elevation view of the impeller.

The impeller 16 can be seen in greater detail in FIGS. 2 and 3 and includes of a plate 25 mounted on the bottom end of shaft 15. Extending around the periphery of the top face of plate 25 are a series of tangentially mounted teeth 26. The plate 25 and teeth 26 are made of graphite.

Figure 2A:
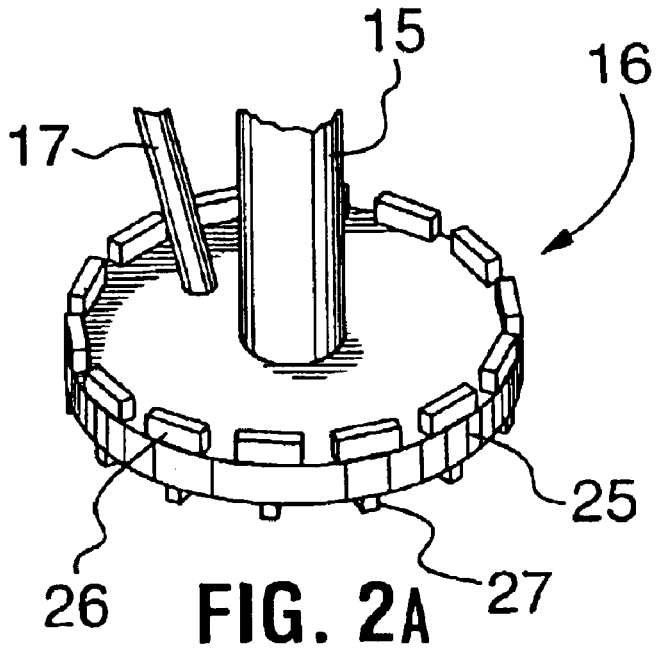
FIGS. 2A and 3A are views, respectively corresponding to FIGS. 2 and 3, of a modified impeller.
Figure 3A:
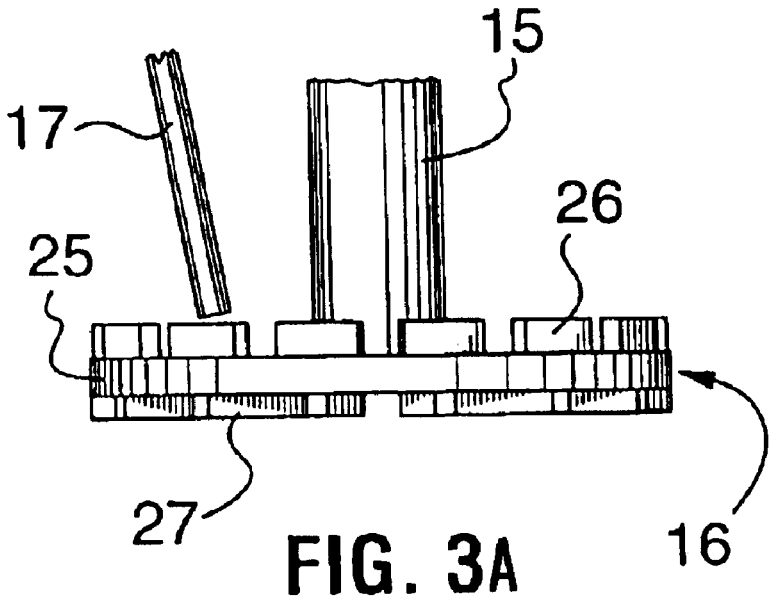

As illustrated in FIGS. 2A and 3A, in combination with the blades 26, additional radially mounted stirring blades 27 may be used to provide additional general mixing of the molter metal within the vessel. These radially mounted stirring blades 27 are mounted on the reverse face of the impeller plate 25 from the position of the peripheral blades 26. Thus, for instance, if the peripheral blades 26 are on the top face of the impeller plate, the radial blades 27 are on the bottom face of the impeller plate, as in the exemplary showing of FIGS. 2A and 3A, but these relative positions can be reversed; i.e., if the peripheral blades 26 are mounted on the bottom face of the impeller plate as shown in FIG. 5 (described below), radial blades having the disposition and dimensions illustrated in FIG. 7 (also described below) may be mounted on the top face of the same impeller plate.

Figure 4:
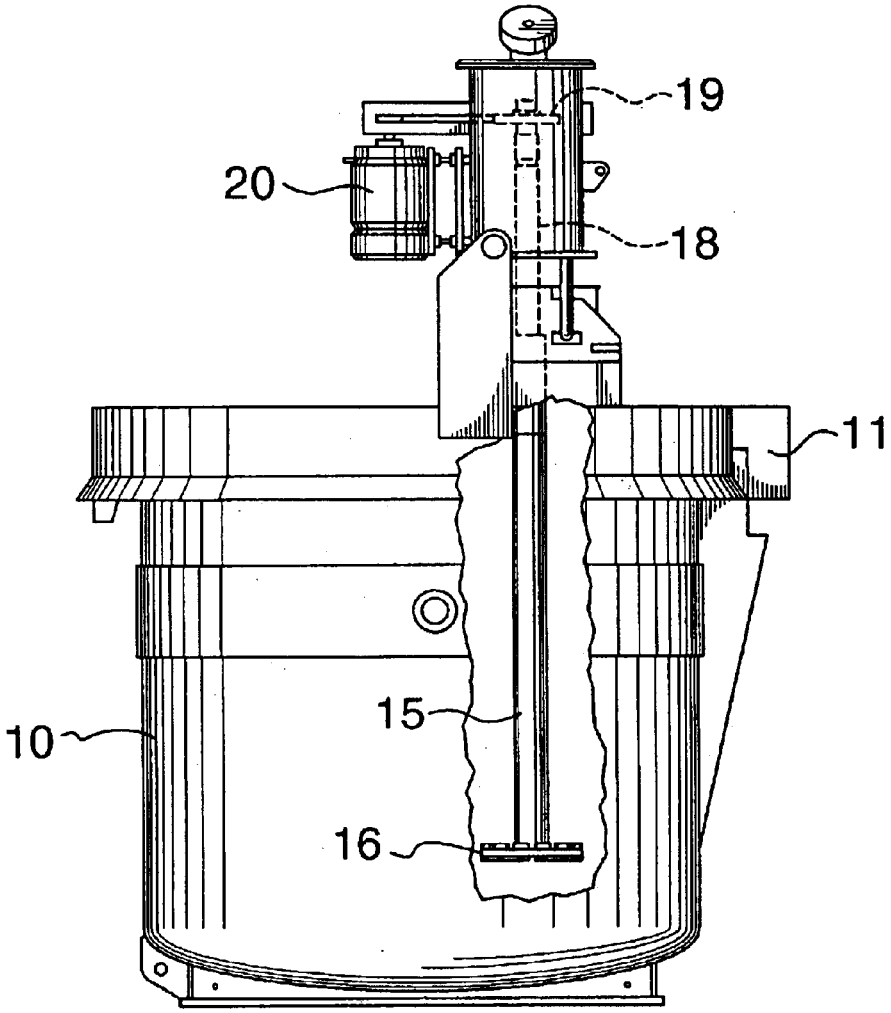
FIG. 4 is a further elevation view in partial section of the treating vessel.

It can be seen from FIG. 4 that the drive shaft 15 and impeller 16 are preferably offset from the center of the ladle 10 with the impeller being in a lower region of the ladle well below the surface of the molten aluminum. Preferably the impeller is at least 50% immersed (that is below the middle of the metal in the ladle). This ensures that any vortex is minimal.

Figure 5:
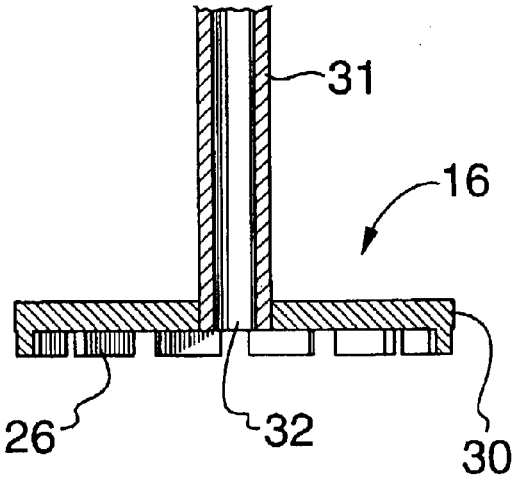
FIG. 5 is an elevation view of a further design of impeller.
Figure 6:
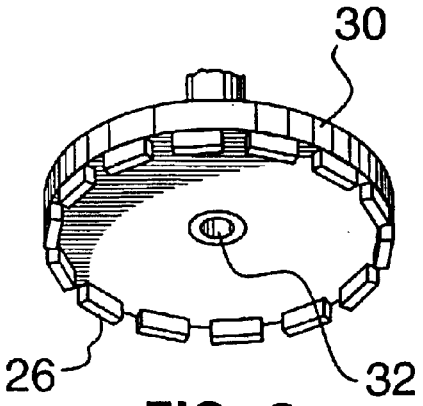
FIG. 6 is a perspective bottom view of the impeller of FIG. 5.

A further embodiment of the invention is shown in FIGS. 5 and 6. In this embodiment, a hollow drive shaft 31 is used which is connected to plate 30 having peripheral teeth 26 projecting from the bottom face thereof. In this design, the plate 30 has a central hole 32 into which the drive shaft 31 is mounted. The treating agent with minimum support gas is fed downwardly through the interior of hollow shaft where it is picked up by rapidly flowing molten metal and is carried outwardly where it encounters high shearing activity in the vicinity of the blades 26.

Figure 7:
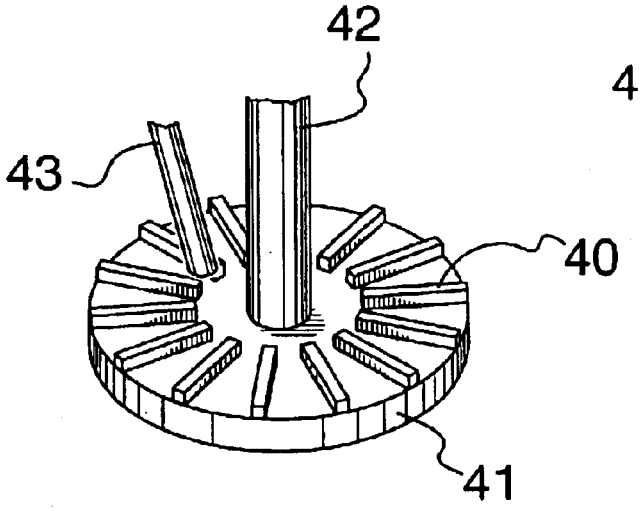
FIG. 7 is a perspective view of a further design of impeller.

A further embodiment of the invention is shown in FIG. 7. In this embodiment, a series of radial blades 40 are mounted perpendicular to the top surface of a circular plate 41 mounted on a rotating shaft 42 and extending outwards to the periphery of the plate. A fixed feed pipe 43 delivers treating agent, with minimum support gas to a point just above the upper edges of the radial blades, inside the periphery of the circular plate. In this embodiment, the radial blades act both to shear the molten or partially molten droplets of treating agent, and to provide stirring of the metal as well.

The radial blades shown in FIG. 7, or any such radial blades mounted on the upper surface of the impeller to stir the molten metal, must not generate excessive drag on the metal which thereby causes a vortex to form. This requires that the blades have a cross-sectional area perpendicular to the movement of the blades that is insufficient to cause vortex formation.

Figure 8:
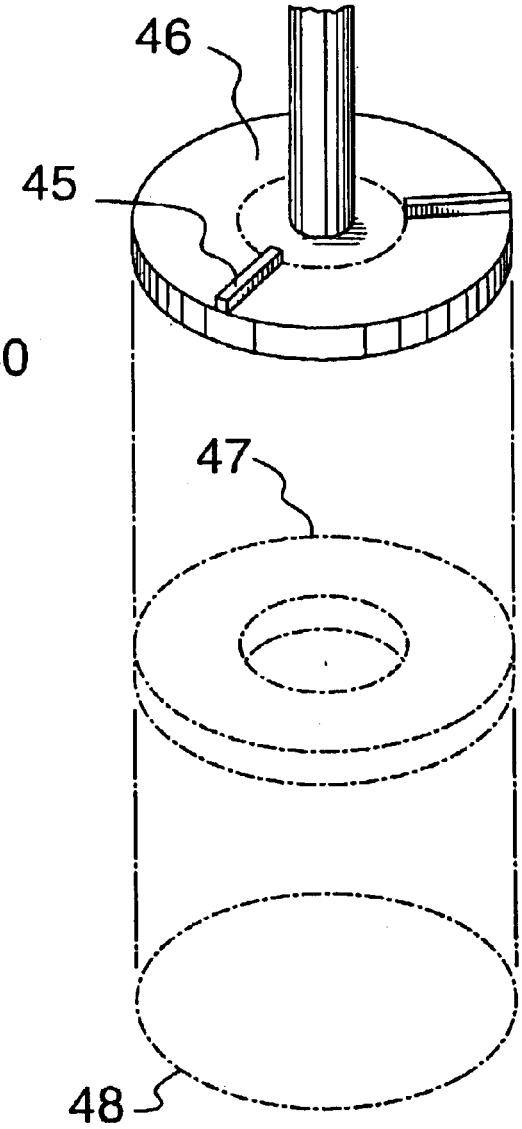
FIG. 8 is a perspective schematic view showing how the swept volume and the area perpendicular to the rotation of the impeller are calculated.

FIG. 8 shows how the limit on cross-sectional area is determined. In this figure, blades 45 are mounted on the top surface of the circular impeller plate 46. For convenience, only two blades are shown but any convenient number may be used. As the plate rotates, the blades sweep out a volume 47. The limitation on the blade area is defined by the ratio of the swept volume 47 to the projected area 48 of the impeller plate. This ratio should preferably not exceed 0.06 metres, and should preferably lie within the range 0.002 to 0.06 metres.

It will be appreciated that the same limitation preferably applies to tangentially mounted blades. However, as the swept volume for such blades will generally be much less than for radially mounted blades, even when the blades extend outwards from the plate a significant distance, the limitation is usually not a serious design consideration.

EXAMPLE 1

Tests were conducted in a commercial ladle as shown in FIGS. 1 to 4. The ladle 10 had an interior diameter of 76 inches (193 cm) and a height of 76 inches (193 cm). A 16 inch (40.6 cm) impeller plate 25 was used with peripheral tangentially mounted teeth 26 each having a length of about 0.75 inch (19 mm) and a height of about 1.5 inches (38 mm). The teeth were circumferentially spaced by a distance of about 20–30 mm. The impeller plate was positioned about 15 inches (38 cm) above the bottom of the ladle 10 and offset from the centre-line by a distance of about 18 inches (46 cm).

The ladle was filled with molten aluminum and treated with 0.36 Kg $MgCl_2$/KCl per ton of metal. The treatment continued for a period of about 8 minutes at an impeller speed of about 640 RPM. In a series of tests, the average calcium content of the aluminum was reduced from about 8.9 PPM to about 1.8 PPM, an 80% reduction. Inclusions (total PoDFA—Porous Disk Filtration Apparatus) were reduced by 55–70% during the tests.

What is claimed is:

1. A process for treating molten metal with a particulate treating agent which comprises the steps of:

(a) providing a melt of a metal in a treatment vessel, (b) providing a mixing impeller within the treatment vessel beneath the surface of the molten metal, the impeller being selected from the group consisting of a plate with a series of spaced blades extending upwards from a surface of said plate and a flat plate with a series of spaced blades extending downwards from the surface of said flat plate, said impeller being adapted to provide high shear mixing with minimum vortex, and (c) while rotating the impeller on a substantially vertical axis, feeding particulate treating agent together with a small flow of inert gas downwardly through an injection tube below the surface of the molten metal adjacent the upper or lower surface of the impeller in a region between the axis and the periphery of the impeller, whereby the treating agent in the form of molten or partially molten droplets is subjected to a high shearing action causing the treating agent to be quickly formed into finely divided droplets within the molten metal.

2. A process according to claim 1, wherein the particulate treating agent is a chloride or fluoride salt.

3. A process according to claim 2, wherein the impeller plate is circular.

4. A process according to claim 3, wherein the impeller blades are directed upwardly and the treating agent is fed downwardly through a fixed injection tube into a region adjacent the upper surface of the impeller between the axis and the periphery of the impeller.

5. A process according to claim 3, wherein the impeller blades are directed downwardly, the impeller is mounted on a hollow, rotatable drive shaft and the treating agent is fed downwardly through the hollow drive shaft to emerge beneath the impeller in a region between the hollow drive shaft and the downwardly directed blades of the impeller.

6. A process according to claim 3, wherein the blades are mounted with the long dimension tangential to the movement of the impeller blades.

7. A process according to claim 3, wherein the metal is aluminum or an alloy thereof.

8. A process according to claim 4, wherein the molten metal in the vessel is further stirred by means of stirring blades radially mounted on the bottom face of the impeller plate.

9. A process according to claim 5, wherein the molten metal in the vessel is further stirred by means of stirring blades radially mounted on the top face of the impeller plate.

10. A process according to claim 3, wherein blades are radially mounted on the top face of the impeller, which blades serve to provide both said high shear mixing and stirring of the vessel contents.

11. A process according to claim 3, wherein the blades travel at a tangential velocity of about 5–20 m/sec. measured at their outer periphery.

* * * * *